US005184605A

United States Patent [19]

Grzeszykowski

[11] Patent Number: 5,184,605

[45] Date of Patent: Feb. 9, 1993

[54] THERAPEUTIC ULTRASOUND GENERATOR WITH RADIATION DOSE CONTROL

[75] Inventor: Miroslaw Grzeszykowski, Mississauga, Canada

[73] Assignee: Excel Tech Ltd., Mississauga, Canada

[21] Appl. No.: 648,596

[22] Filed: Jan. 31, 1991

[51] Int. Cl.[5] ..... A61H 1/00

[52] U.S. Cl. ..... 128/24 AA

[58] Field of Search ..... 128/660.03, 24 AA; 604/22

[56] References Cited

U.S. PATENT DOCUMENTS

| | | | |
|---|---|---|---|
| 3,980,906 | 9/1976 | Kuris et al. | 128/24 AA |
| 4,302,728 | 11/1981 | Nakamura | 331/25 |
| 4,368,410 | 1/1983 | Hance et al. | 318/116 |
| 4,583,529 | 4/1986 | Briggs | 128/24 |
| 4,614,178 | 9/1986 | Harlt et al. | 128/24 AA |
| 4,642,581 | 2/1987 | Erickson | 331/154 |
| 4,708,127 | 11/1987 | Abdelghani | 128/24 |
| 4,754,186 | 6/1988 | Chopereno et al. | 310/316 |
| 4,768,496 | 9/1988 | Kreizman et al. | 128/24 AA |
| 4,791,915 | 12/1988 | Barsotti et al. | 128/24 |
| 4,811,740 | 3/1989 | Ikeda et al. | 128/660.01 |
| 4,827,911 | 5/1989 | Broadwin et al. | 128/24 AA |
| 4,849,872 | 7/1989 | Gässler | 363/49 |
| 4,966,131 | 10/1990 | Houghton et al. | 128/24 |

*Primary Examiner*—Francis Jaworski

*Attorney, Agent, or Firm*—Fliesler, Dubb, Meyer & Lovejoy

[57] ABSTRACT

A therapeutic ultrasound generator controlling an ultrasonic transducer based on actually sensing the amount of power radiated by the transducer to the patient. A controllable ultrasound generator, supplies a controllable amount of electric power to a transducer. A sensing circuit, coupled to the transducer, senses an amount of power radiated by the transducer. A control loop, which is responsive to the amount of power radiated, and a preset radiation power, controls the controllable amount of electric power delivered to the transducer. The radiation power is sensed by detecting an instantaneous current through the transducer, and an instantaneous voltage across the transducer. The instantaneous current and voltage are then used to compute an impedance. The computed impedance, and known characteristics of the transducer, are used to determine the actual amount of power radiated by the transducer to the patient. The generator can also be programmed to provide a preset dosage of energy over coupling conditions varying beyond the range within which the power control loop can supply constant radiated power. The applicators each include an indicator of an applicator type. A circuit is provided for reading the indicator, and supplying characteristics of the transducer for use in determining the amount of power radiated. The control circuit automatically self calibrates by measuring the resonant frequency, and transducer loss resistance for each applicator coupled to the device.

37 Claims, 6 Drawing Sheets

FUNCTIONAL BLOCK DIAGRAM

FUNCTIONAL BLOCK DIAGRAM

FIGURE 7 APPLICATOR with TEMPERATURE and ID SENSING CIRCUIT

U, I, R SENSING CIRCUIT

THERAPEUTIC ULTRASOUND GENERATOR WITH RADIATION DOSE CONTROL

BACKGROUND OF THE INVENTION

1. Field of the Invention

The present invention relates to ultrasound therapy devices with automatic control power radiated to the patient under changing coupling conditions, or to other applications of ultrasonic wave generators where precise control of radiated power under varying load conditions is required.

2. Description of Related Art

Therapeutic ultrasound units currently on the market employ high frequency oscillators and power amplifiers to generate a high frequency electrical signal that is then delivered to a piezoelectric transducer housed in a handheld applicator. The transducer converts the electrical signal to ultrasonic energy at the same frequency. The ultrasonic energy is then transmitted to the patient by applying a radiating plate on the transducer against the patient's skin.

Out of the total power of the electrical signal delivered to the transducer, only a part is actually radiated to the patient's tissue as ultrasonic energy. The other part of the total power is dissipated in the transducer and parts of the applicator in the form of heat. As the applicator is moved over a treatment site, the acoustic coupling to the patient's body changes, resulting in a change in the proportion of the power radiated to the patient relative to the power dissipated in the transducer. This coupling efficiency change is caused by changes in acoustic impedance as different types of tissue are encountered, and as air, whose acoustic impedance is much different than that of tissue, enters the space between the skin and the applicator.

The typical therapeutic ultrasound unit of the prior art allows for measurement and manual or automatic control of the total electrical power delivered to the transducer. However, as mentioned above, due to changing coupling efficiencies as the applicator is moved, the amount of power delivered to the transducer is often an inaccurate indication of the actual amount of power radiated to the patient. These prior art systems which control the amount of power delivered to the transducer have power meters or power control systems calibrated corresponding to radiated power for the average good coupling conditions. These conditions are typically simulated by radiating ultrasonic energy into de-gassed water, or under other simulation conditions. These calibration techniques, based on average good coupling conditions, are highly inaccurate in many practical uses of therapeutic ultrasound equipment. The proportion of the power radiated to the patient of the total power delivered to the transducer changes significantly under real treatment conditions, resulting in a significant error in these prior art techniques for determining the amount of radiated power to a patient.

Furthermore, these prior art systems are equipped with timers that can be programmed for fixed treatment time. This fixed treatment time is selected in response to a desired dosage of ultrasonic energy for given therapeutic needs. However, as the power radiated to the patient changes during the treatment in an uncontrolled way due to changes in coupling efficiency, the actual radiation dose received by the patient over the treatment time cannot be accurately assessed.

Therefore, the prior art systems have been unable to measure the power radiated to a treatment site instantaneously, or to effectively determine the total radiation dose given during a treatment cycle.

The therapeutic ultrasound units of the prior art typically do not provide an indication of coupling of quality. Some units provide an indicator of the decoupled condition, or a four level coupling indicator. Very few units provide wide range, high resolution coupling meter. Those that do are still limited to the type of applicators with which they have been factory calibrated to operate.

These coupling indicators or meters actually indicate changes to the radiation power as the coupling changes. The units of the prior art are not capable of maintaining constant radiating power while monitoring changing coupling conditions.

Also, in prior art systems, transducer overheating in uncoupled conditions is addressed. When the coupling efficiency of a transducer approaches zero, such as when the applicator has been tilted, or moved to an area With insufficient amount of coupling gel, essentially all of the power delivered to the transducer is dissipated in heat, warming up the applicator. This can result in overheating and permanent damage to the transducer This problem is particularly severe in the prior art units that employ a power control loop maintaining constant power to the transducer such as described in U.S. Pat. No. 4,368,410, to Hanoe, et al.

To prevent overheating, some prior art units employ a warning signal that comes on when an uncoupled condition is detected and the operator is required to shut the power down. Other units employ temperature sensors mounted inside the applicator to detect overheating and automatically shut the power down. The approach involving a warning signal in the uncoupled condition does not protect the applicator against human error. The technique involving shutting down the power in response to overheating, requires a long cooling period before the unit can be put in service again.

Prior art systems also require frequent calibration. Even under ideal controlled coupling conditions, a nominal radiation power accuracy cannot be guaranteed unless the unit undergoes periodic calibration. This is true because the parameters of the ultrasonic transducers that influence the power ratio change with time. Also, any change in the type of applicator, or the applicator within the same type, necessitates further power calibration.

In ultrasonic generating units, the frequency of the oscillator has to be tuned to the resonant frequency of the transducer. Most of the units on the market employ manually tuned oscillator that is factory adjusted for operation with a specific applicator. Any change of applicator, such as replacement of a damaged applicator, requires re-tuning and power calibration that can only be done in a specialized laboratory. Since the resonant frequency of the transducer changes as it ages, a periodic re-tuning of the unit is also required.

Some units employ phase lock loops that continuously update oscillator frequency to achieve zero phase error between voltage and current driving the transducer, such as described in U.S. Pat. No. 4,302,728, to Nakamura. Using the phase lock loop eliminates the need for periodic re-tuning. It becomes impractical, however, when self tuning with a wide range of different types of applicators is required. For instance, standard applicators currently in use, operate with either 1 MHz or 3 MHz as the center of ultrasonic drive frequency ranges. Each of these frequency ranges requires a different type of phase shift circuit for the phase look loop. Thus, a single control unit cannot be used for either type of applicator.

Another problem in the design of ultrasound equipment arises because the applicator radiating surface causes an unpleasant feeling when applied against a patient's skin, unless it is warmed up. It is desirable to keep the applicator at a temperature elevated to approximately the temperature of the human body. Some elements of the prior art offer applicator warming feature implemented by means of a resistive heating element mounted inside the applicator and continuously powered. This approach has the disadvantage of being expensive to manufacture and in absence of power control offering long warmup time and low temperature stability.

Accordingly, it is desirable to provide a system for controlling power delivered to an ultrasonic applicator that provides greater control over actual dosage of ultrasonic energy, can handle a wide variety of applicator types without expensive, factory re-calibration or tuning, and overcomes other problems discussed above of prior art ultrasonic therapy units.

SUMMARY OF THE PRESENT INVENTION

The present invention provides an apparatus for controlling an ultrasonic transducer based on actually sensing the amount of power radiated by the transducer to the patient. Thus, according to one aspect, the present invention comprises a connector which is adapted to be connected to an ultrasonic transducer. A controllable ultrasound generator, supplies a controllable amount of electric power to a transducer connected to the connector. A sensing circuit, coupled to the connector, senses an amount of power radiated by the transducer. A control loop, which is responsive to the amount of power radiated, and a preset radiation power, controls the controllable amount of electric power delivered to the transducer.

The sensing circuit detects a coupling efficiency of the transducer while it is coupled to a treatment site. This is accomplished according to one aspect of the invention by detecting an instantaneous current through the transducer, and an instantaneous voltage across the transducer. The instantaneous current and instantaneous voltage are then used to compute an impedance. The computed impedance, and known characteristics of the transducer, are used to determine the actual amount of power radiated by the transducer to the patient. A part of the computed impedance of the transducer that corresponds to radiated energy is used as an indication of coupling efficiency between the applicator and the patient.

According to another aspect, the apparatus is adapted for use with a wide variety of applicators. The applicators each include an indicator of an applicator type. A circuit is provided for reading the indicator, and supplying characteristics of the transducer for use in determining the amount of power radiated.

According to another aspect, the control circuit automatically self calibrates by measuring the resonant frequency, and transducer loss resistance for each applicator coupled to the device.

According to yet another aspect, the power control loop is utilized in a self warming mode. According to this aspect, each of the applicators includes a temperature sensor which is continuously monitored during a warm-up mode. The power control loop delivers a controlled power to the applicator until the temperature sensor indicates the desired temperature has been reached.

Other aspects and advantages of the present invention will be seen upon review of the FIGURES, the detailed description and the claims Which follow.

DETAILED DESCRIPTION

Figure 7:
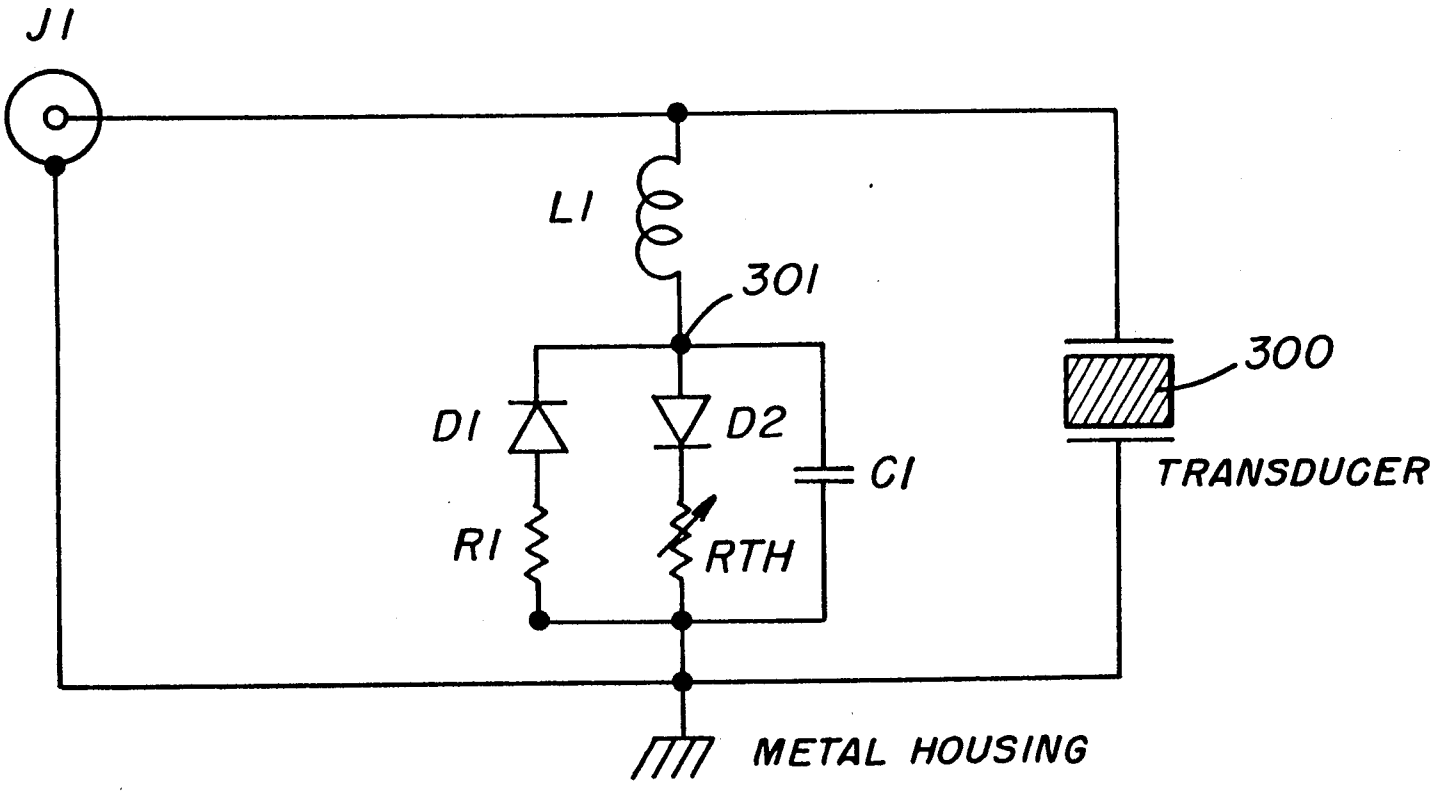
FIG. 7 is a schematic diagram of an applicator with temperature and identification sensing circuit according to the present invention.
Figure 8:
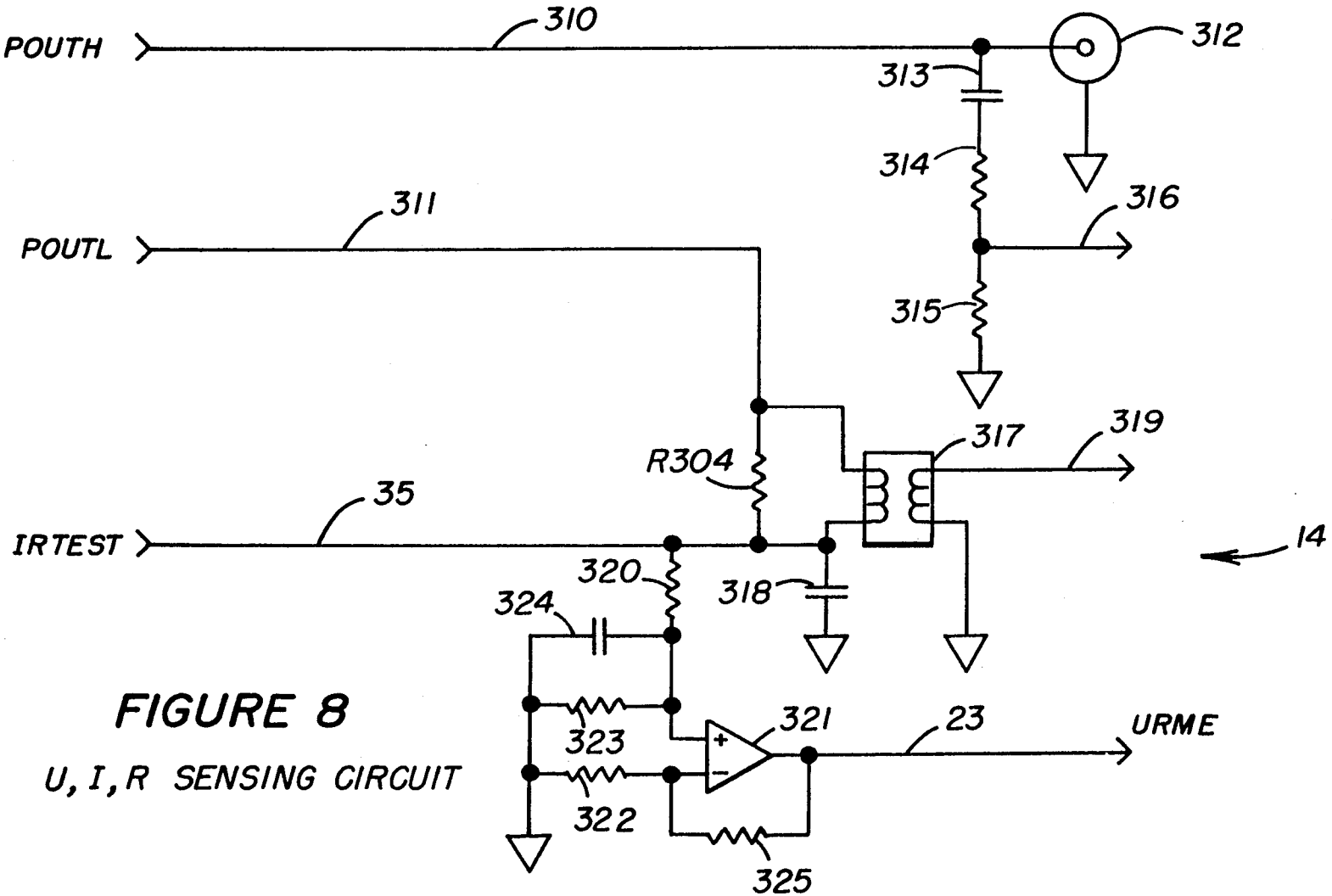
FIG. 8 is a schematic diagram of the voltage, current, temperature, and identification resistance sensing circuit in the control circuit of FIG. 1.

A detailed description of a preferred embodiment of the present invention is provided with reference to the FIGURES. The structure and function of the power control and calibration control circuits are presented with reference to FIGS. 1–6. FIGS. 7 and 8 provide more detailed schematics of the voltage, current, and DC resistance sensing circuit and the applicator temperature control and identification circuit according to the present invention.

Figure 1:
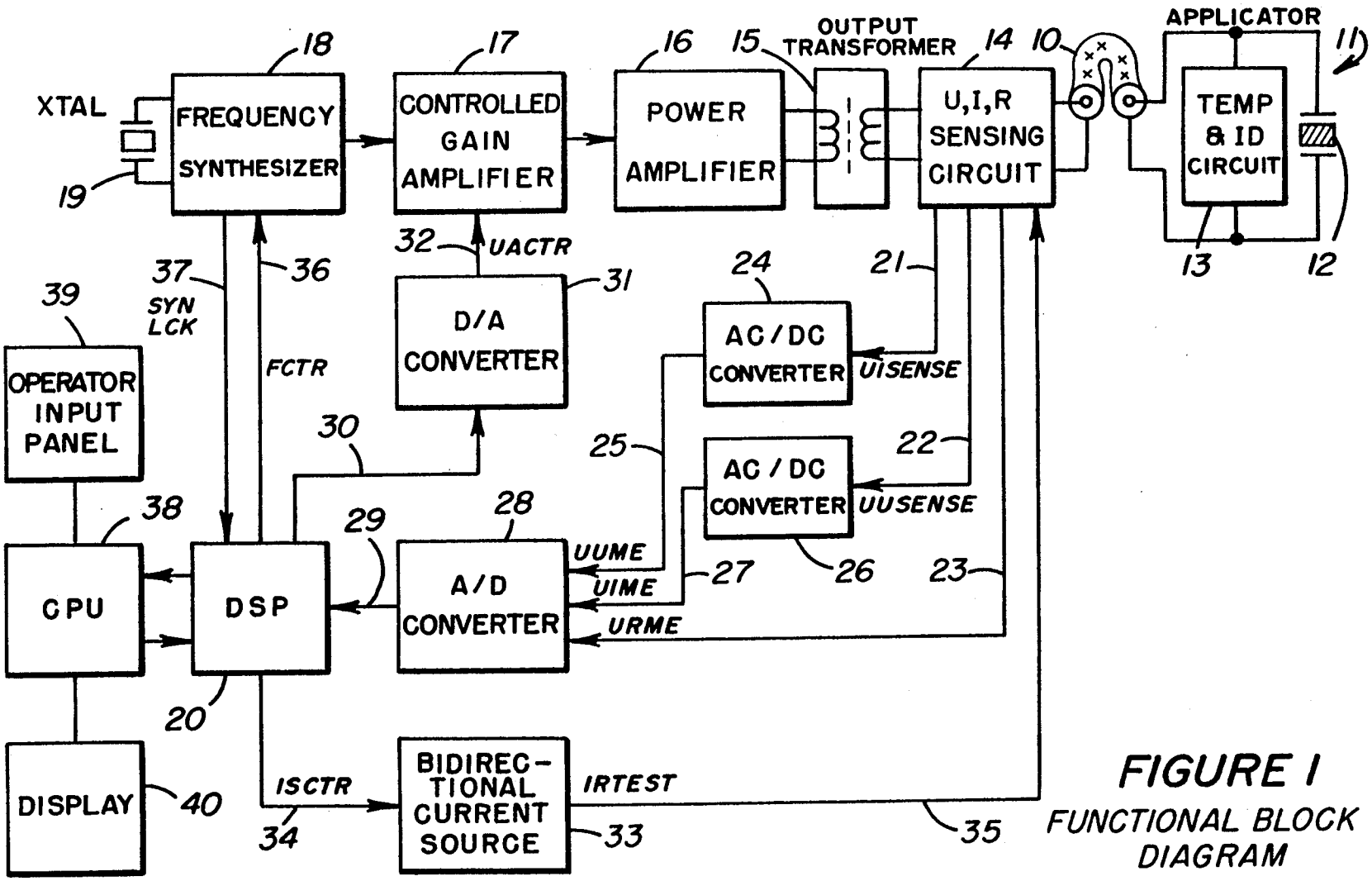
FIG. 1 is a functional block diagram of the ultrasonic therapy device of the present invention.

As illustrated in FIG. 1, the therapeutic ultrasound device, according to the present invention, provides a high frequency electrical signal across connector 10 to an applicator 11, which is connected to the connector 10. The connector 10 typically comprises a coaxial cable, or other suitable fittings for attaching the applicator in the control circuit.

The applicator, according to the present invention, includes an ultrasonic transducer 12 connected in parallel with a temperature control and identification circuit 13 across the connector 10.

On the control side of the oonnector 10, a voltage, current, and resistance sensing circuit 14 is coupled to the connector 10. This circuit 14 is used for supplying input signals to the control loop as described below. It is mounted on the applicator side of an output transformer 15 which is supplied with a controlled amount of electric power by power amplifier 16 in the ultrasound generator referred to generally by the reference number 99. The power amplifier 16 is controlled by a controlled gain amplifier 17 at a frequency selected by frequency synthesizer 18, which is coupled to an external crystal 19 for supplying a reference frequency.

The control loop operates under the computing power of digital signal processor 20. Inputs to the digital signal processor 20 are supplied from the sensing circuit 14 including the instantaneous current signal UISENSE on line 21, the instantaneous voltage signal UUSENSE on line 22, and an instantaneous measured resistance signal URME on line 23. The UISENSE signal line 21 is coupled through an AC to DC converter 24 as the UUME signal on line 25. Similarly, the UUSENSE signal on line 22 is coupled through AC to DC converter 26 as the UIME signal on line 27. The UUME signal on line 25, UIME signal on line 27, and URME signal on line 23 are supplied through an analog to digital converter 28 as inputs to the digital signal processor 20 across line 29.

The digital signal processor 20 utilizes these signals in generation of a loop power control signal on line 30. This signal is converted in digital to analog converter 31 to the UACTR signal on line 32. The UACTR signal on line 32 operates to control the gain of controlled gain amplifier 17, and therefore, the amount of power delivered to the transducer in the applicator 11.

Also included in the control loop for detection of applicator type and measuring the temperature of the applicator is the bidirectional current source 33. The bidirectional current source 33 receives a control signal ISCTR across line 34 from the digital signal processor 20. In response to the control signal, a current IRTEST is supplied on line 35 coupled through the sensing circuit 14 and connector 10 to the applicator 11. As explained below, for a first current direction, the signal URME on line 23 indicates the temperature of the applicator. For a second current direction of the IRTEST current on line 35, the URME signal on line 23 indicates the type of applicator coupled to the connector 10.

The digital signal processor 20 also supplies a frequency control signal FCTR across line 36 to the digital frequency synthesizer 18, as explained below. The frequency synthesizer 18 supplies a look signal SYNLCK across line 37 to the digital signal processor 20.

Overall supervision of the control circuit is provided by a programmable central processing unit 38. Also, the CPU receives treatment parameters and other information from an operator through an operator input panel 39, and displays information about the status of the control circuit to the operator by means of display 40. In particular, the display 40 includes a bar graph type display, or other high resolution indicator, for displaying to the operator the actual coupling efficiency of the applicator.

The control circuit of the present invention is adapted for operation with a wide variety of applicators. Thus, stored in the CPU memory are characteristics of the applicator types which the control circuit may be used with.

The following sequence of actions illustrates principles of operation of the unit of the invention.

1. Performing Power Up Sequence

CPU 38 and DSP 20 are reset and programs are loaded from memory.

2. Reading of Applicator's ID Resistance

The bidirectional current source 33 is set so that the applicator type is indicated by the signal URME, and an applicator ID code is generated. The following information corresponding to the applicator's ID code is retrieved from the CPU memory:

Operating Frequency Ranges
Effective Radiating Area (ERA)
Maximum Radiation Power (PRmax)
Maximum Dissipated Power (PLmax)
Calibration Power (PC).

3. Performing Applicator Calibration

Operating frequency ranges of the application 11 are scanned in search of minimum of the magnitude of impedance. The power control loop operating at P=PC and TYPE=0 (total power control) is used. For each frequency range, (1 MHz and 3 MHz for preferred embodiment), two scans, coarse and fine, are performed, delivering optimum tradeoff between accuracy and duration of the scan. As a result, a set of two values, Fs (the series resonant frequency of the transducer) and RL (the impedance of the transducer at frequency Fs), for each range is found and stored.

4. Entering Treatment Parameters

The CPU 38 reads treatment parameters entered by user via controls mounted on the operator input panel 39. Optionally, one of a set of pre-programmed configurations can be re-called from memory. The following use selectable parameters make up treatment configuration:

Radiation Power
Frequency (range)
Treatment Time
Energy or Fixed Time Mode
Continuous or Pulsed Mode 5. Running Treatment The CPU 38 sends to the DSP 20 the following set of power control loop parameters:

F—Operating Frequency (equal to stored value of Fs for the selected range)

P—Preset Radiation Power (selected by user; no larger than PRmax)

TYPE=1—Loop type selection corresponding to Radiation Power control

RL—Transducer loss resistance value for the selected frequency range (from calibration)

IMAX—Transducer Current Limit. Calculated by the CPU based on applicator—s PLmax (maximum power dissipation allowed without causing applicator overheating) and its RL value.

IMAX=square root of PLmax RL

The power control loop is started and operates until treatment time expires or alternately (if Energy Mode is selected) until the total energy of radiation dose is delivered. The total energy is computed by the CPU 38 as an integral of instantaneous value of PR over treatment time.

The CPU 38 receives from the DSP 20 and displays via the display 40 the instantaneous value of radiated power PR. This value is maintained at the preset level P by the action of the power control loop over a wide range of load or coupling efficiency. When the coupling degrades to the point that IMAX would have to be exceeded in order to maintain the preset value of PR the loop maintains constant output current allowing the PR to drop. This way power dissipated in the applicator is limited to the value of PLmax preventing applicator 11 from overheating. In the extreme case of fully decoupled applicator 11, the value of PR drops to zero and the total power delivered to the transducer is equal to PLmax.

When the power control loop is operated in the Energy Mode, the input P for desired radiation power and an input indicating the treatment time are used to calculate in the CPU 38 the total amount of energy to be delivered to the treatment site. The CPU continuously integrates the instantaneous value of PR, until the desired energy value is reached. At that point, the loop is terminated. In the Fixed Time Mode, the power control loop terminates after expiration of the fixed time. Of course, alternative systems provide a preset energy dosage as a direct input.

The value of RR (resistance representing radiation losses as explained below) reported to the CPU 38 by the DSP 20 is used (after scaling) to drive high resolution (bar graph type) coupling meter on the display 40.

6. Applicator Self Warming Mode

If this mode is selected, the power is delivered to the uncoupled applicator 11 under control of the power control loop with simultaneous monitoring of applicator temperature. A thermistor mounted inside the applicator is used as a temperature sensor in combination with setting the bidirectional current source 33 so that the signal VRME indicates the voltage across the thermistor (RTH in FIG. 7).

Figure 2A:
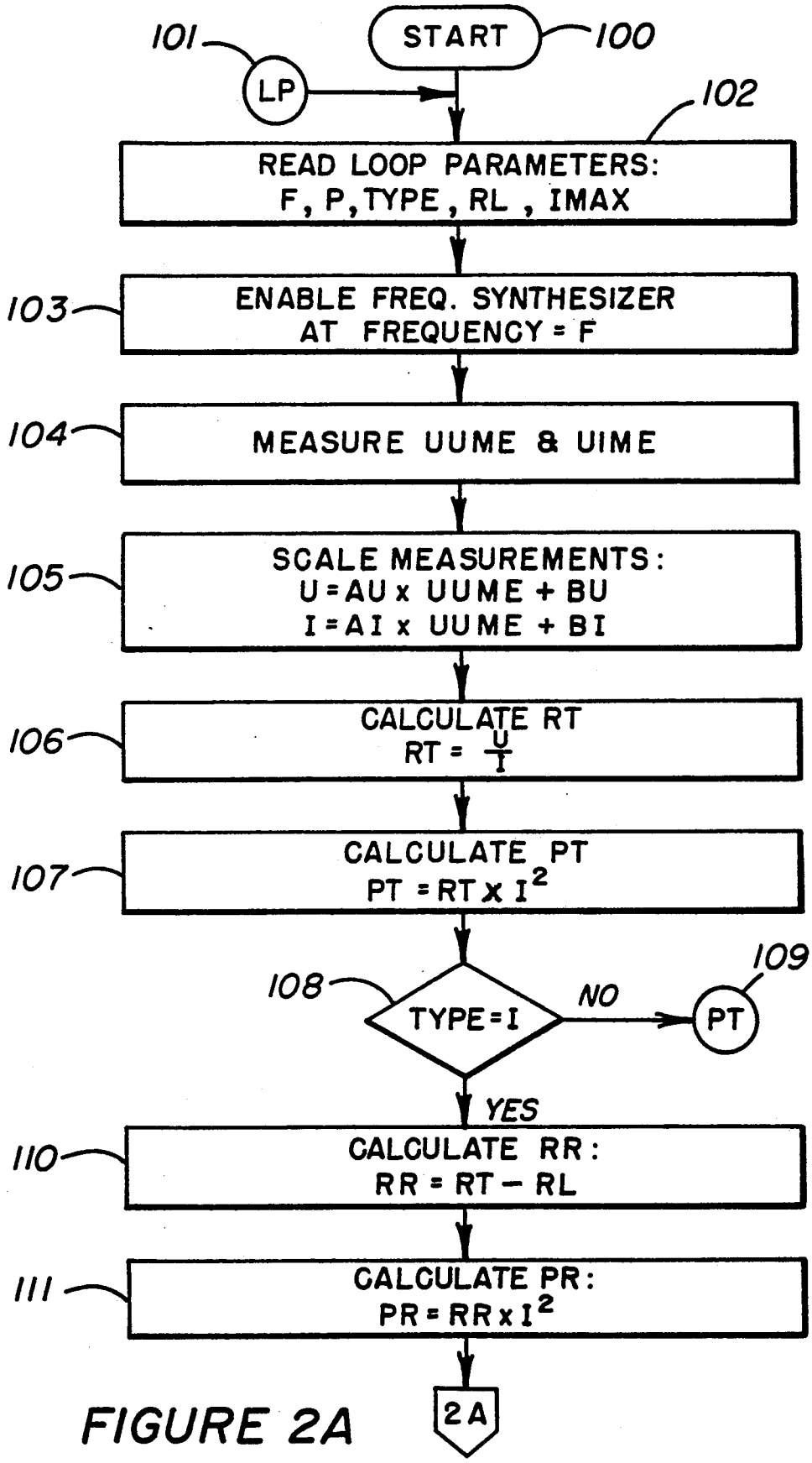
FIG. 2*a* and 2*b* provide a flow chart of the power control loop according to the present invention.
Figure 2B:
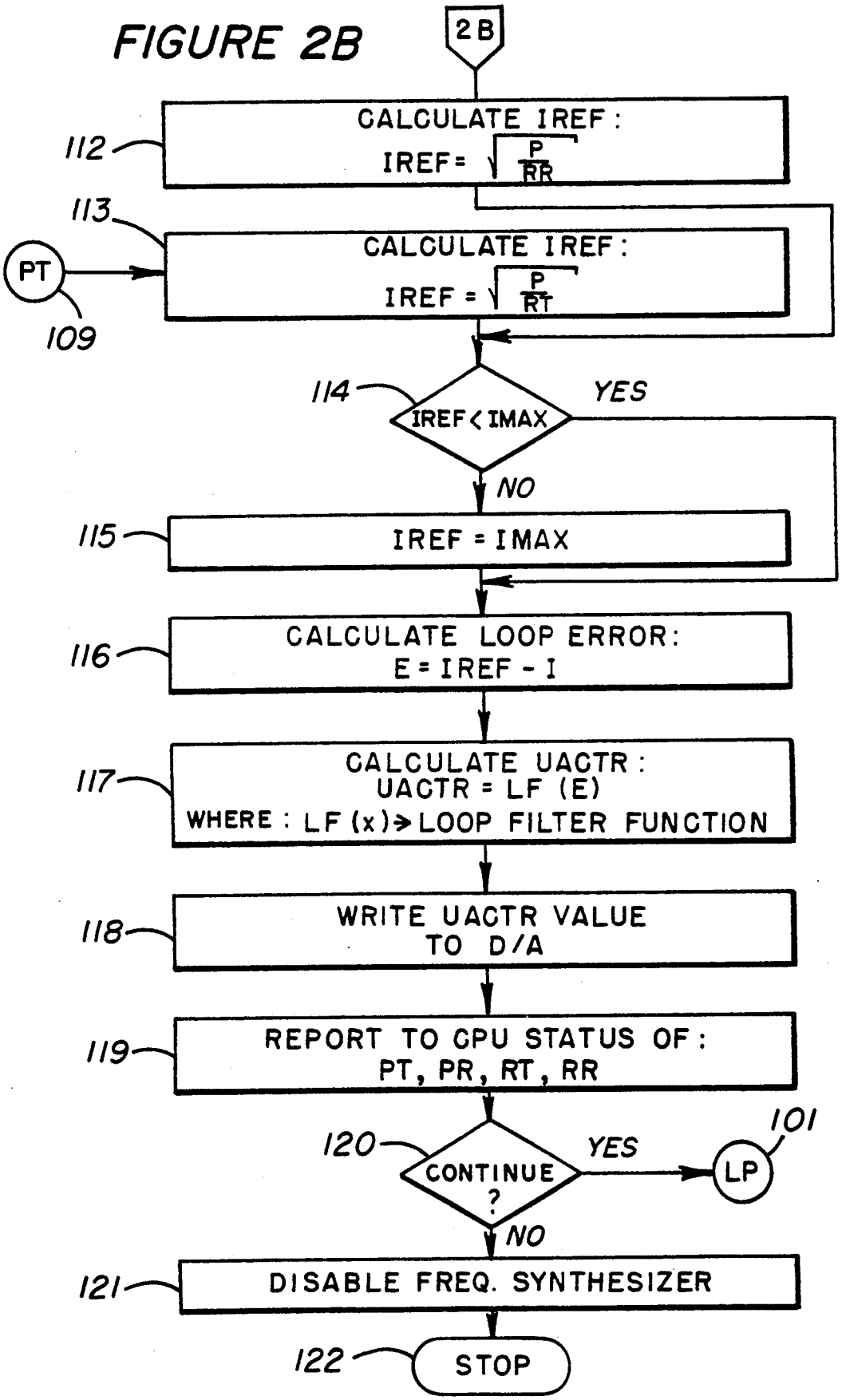

FIGS. 2*a* and 2*b* provide a flow chart of the power control loop algorithm referred to above. As mentioned above, the program starts at point 100, which is also the loop return point 101. First step is to read the loop parameters: F, P, TYPE, RL, IMAX (block 102). Then the frequency synthesizer is enabled at frequency equal to F (block 103). Next, the loop measures UUME and UIME from lines 25 and 27, respectively (block 104). Next, the measurements are scaled by the digital signal processor according to the formulas indicated at block 105, where AU, BU, AI, and BI are factory calibration constants for the voltage and current sensing circuits, respectively. Next, the instantaneous total impedance RT of the loaded applicator is calculated as indicated at block 106. Then, the total power transmitted to the applicator PT is calculated (block 107).

Next, the loop determines whether the type of control loop is for radiated power, or total power (block 108). If it is a total power loop, then a branch is taken as indicated at block 109. If the loop is operating in a radiated power mode, then the next step is to calculate the impedance RR that represents radiation losses. This is done by subtracting the characteristic impedance RL of the uncoupled applicator which has been stored in the computer from the total impedance RT of the coupled applicator (block 110). The radiated power PR is then calculated as indicated at block 111. A reference current IREF is calculated by taking the square root of the preset radiation power P divided by the radiation loss impedance RR, as indicated at block 112 (now in FIG. 2*b*).

If, at block 108, the loop type indicated a total power loop, then the branch 109 goes through a routine which calculates the reference current IREF based on the square root of the preset radiation power P divided by the total impedance of the loaded transducer RT as indicated at block 113.

After block 112, or block 113, depending on the type of control loop, IREF is tested against IMAX in block 114. If IREF is greater than or equal to IMAX, then IREF is set equal to IMAX (block 115). If IREF remains less than IMAX, then a loop error signal is calculated, defined as the difference between IREF and the scaled current measurement I (block 116). The control signal UACTR is then calculated based on a loop filter function as indicated at block 117. Next, this control signal U ACTR is written to the digital to analog converter 31 (block 118). Status of the total power PT, radiated power PR, total impedance RT, radiation loss impedance RR are all reported to the CPU (block 119) and it is determined whether the loop should continue at block 120. If the loop continues, a branch is taken to the loop node 101 (See FIG. 2*a*). If the control loop is to be turned off, the frequency synthesizer is disabled (block 121) and the loop stops (block 122).

Figure 3:
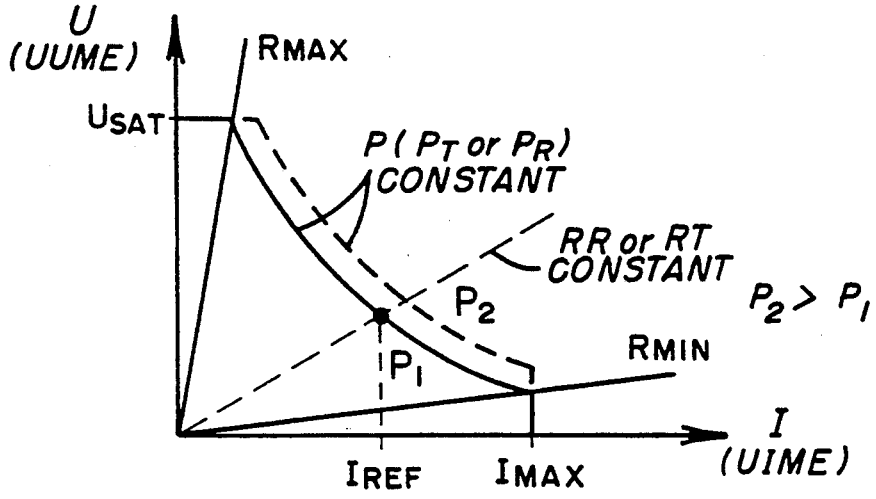
FIG. 3 is a graph illustrating operation of the power control loop of the present invention.

FIGS. 3–6 provide a background for the theory of operation of the power control loop. FIG. 3 is a graph illustrating the measured voltage UUME versus the measured current UIME for constant output power. As can be seen, for a constant power P1, and a known ratio of voltage to current (i.e., impedance), a reference current IREF can be calculated. The curve illustrated applies equally for the total power servo loop or the radiated power servo loop. As can be seen, for given impedance RR or RT, a current IREF can be determined.

Figure 4:
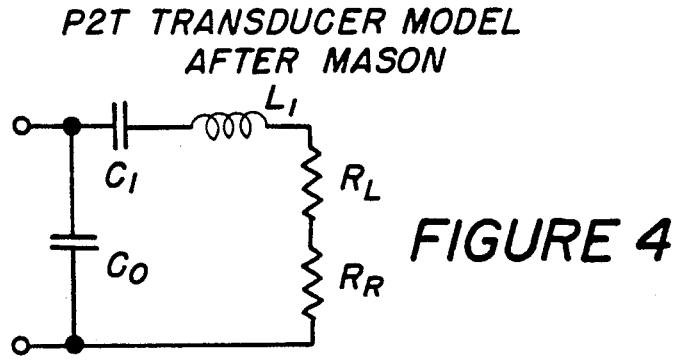
FIGS. 4, 5, and 6 provide a transducer model for the preferred system on which the principles of radiation control and transducer calibration in the preferred embodiment are based.
Figure 5:
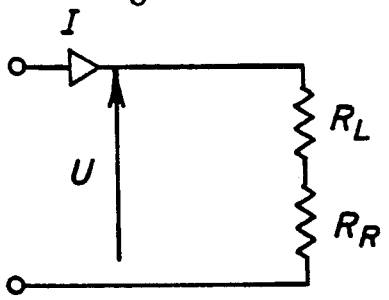

FIG. 4 illustrates the model of an ultrasonic transducer, after Mason. Thus, the coupled transducers can be modeled as a circuit comprised of a capacitor C1, inductor L1, resistor RL, and resistor RR, in series, with a capacitor C0 connected across the four previously mentioned elements. The elements C1, TM L1 and RL represent motional capacitance, inductance, and resistive losses, respectively, of the electoral equivalent of mechanical vibration within the transducer. The capacitance CO represents static capacitance present between transducer electrodes, plus the capacitance of the circuit and cable attached to the transducer. The resistance RR represents electrical losses corresponding to the radiated ultrasonic energy. At the series resonant frequency, this circuit can be approximated by the series circuit of RL and RR illustrated in FIG. 5.

Figure 6:
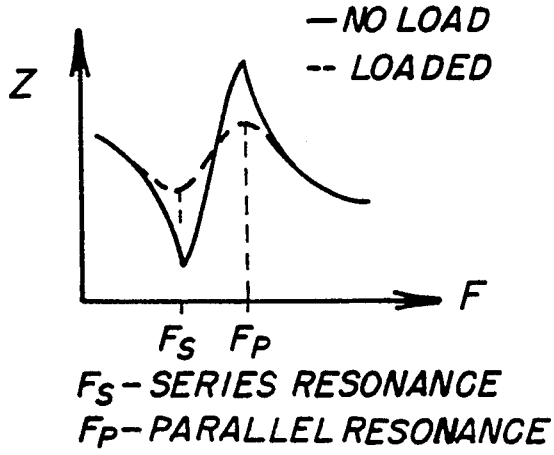

FIG. 6 illustrates the impedance versus frequency of the transducer model. This illustrates that the scanning technique, in which sensing for the minimum impedance of the transducer can be utilized to detect the series resonant frequency.

The terms can be understood with reference to FIGS. 3–6, as follows:

| | |
|---|---|
| PT = V × I | Total Power Delivered to Transducer |
| RT = V/I | Total Load Resistance (at Fs of Transducer) |
| RL = | Transducer Loss Resistance (at Fs) |
| RT = RL | At Fs when Transducer is Uncoupled |
| RR = RT − RL | Resistance Representing Radiation Losses |
| PR = I2 × RR | I = square root of PR/RR |
| PT = I2RT | I = square root of PT/RT |
| RMIN = P/IMAX$^2$ | |

FIG. 7 is a schematic diagram with the applicator with the temperature and identification sensing circuit of the present invention. Thus, the applicator is coupled to connector J1. The transducer 300 is coupled across the connector Jl with a first terminal connected to the center wire, and a second terminal connected to the ground shield and the metal housing of the applicator. A circuit is included within the applicator, including inductor Ll connected from the center wire of oonnector J1 to node 301. A first diode Dl has its anode connected to node 301, and its cathode connected across resistor R1 to the ground terminal. This resistor R1 is an indicator of the type of transducer. Also, a second diode D2 has its cathode connected to node 301 and its anode connected across thermistor RTH to ground. This thermistor RTH is used to indicate the temperature of the applicator.

Finally, capacitor C1 is coupled across node 301 to ground. Thus, when the bidirectional current source supplies IRTEST across line 35 in a first direction, current flows through the thermistor RTH. When the bidirectional current source supplies the current IRTEST 35 in second direction, the current flows across resistor R1 indicating the applicator type. The inductor L1 and capacitor C1 form a lowpass filter that reduces the level of high frequency voltage across the node 301 and ground, preventing diodes D1 and D2 from being turned on by peaks of the signal that drives the transducer.

FIG. 8 indicates the voltage, current, and resistance sensing circuit 14 of FIG. 1. Although a variety of sensing circuits could be utilized, FIG. 8 is provided to illustrate the preferred mode for sensing these parameters.

The output transformer 15 of FIG. has a high output terminal POUTH which is connected to line 310, and a low output terminal POUTL which is connected to line 311. Line 31 is coupled to the center wire of the connector 312. Also, it is AC coupled across capacitor 313 to voltage divider including resistor 314 and resistor 315 to the power ground. The UUSENSE signal is supplied at the voltage divided node 316.

The POUTL signal on line 311 is coupled through primary winding of transformer 317 and capacitor 318 to the power ground. In addition, resistor R304 is coupled across the primary winding of the transformer 317. The signal UISENSE is supplied on line 319 across the secondary winding of the transformer 317.

The IRTEST current is supplied by the bidirectional current source on line 35. The IRTEST current 35 gets coupled into the applicator through primary winding of resistor 317 along line 311 through the power transformer and across line 310 to the applicator. Line 35 is also coupled through resistor 320 to the input of operational amplifier 321. The inverting input of operational amplifier 321 is connected through resistor 322 to the analog ground. Resistor 323 and capacitor 324 are connected in parallel from the non-inverting input of operational amplifier 321 to the analog ground. Feedback resistor 325 is connected from the output of the operational amplifier 321 to the inverting input. The URME signal is supplied on line 23 at the output of the op-amp 321.

As can be seen, an ultrasonic therapy device has been provided which is self-calibrating, and provides a superior control over the amount of radiation actually delivered to a patient. These benefits greatly simplify the operation of the ultrasonic generators in medical therapy, and improve the certainty with which a given treatment can be accomplished. Furthermore, a single control circuit can be utilized in combination with a variety of applicators without requiring expensive, factory re-calibrating and re-tuning.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. An apparatus for controlling an ultrasonic transducer, comprising:

a connector adapted to be connected to the transducer connected to the connector for radiating ultrasonic power to a treatment site in response to electric power;

means, coupled to the connector, for supplying a controllable amount of electric power to the transducer connected to the connector;

means, coupled to the oonnector, for sensing an actual amount of power radiated by the transducer connected to the connector under conditions of varying coupling efficiency during use; and means, coupled to the means for sensing and the means for supplying, for controlling the means for supplying in response to the amount of power radiated and a preset radiation power.

2. The apparatus of claim 1, wherein the means for controlling operates to maintain the amount of power radiated essentially constant by controlling the amount of electric power up to a preset maximum amount of electric power.

3. The apparatus of claim 1, wherein the means for sensing comprises:

means for detecting a coupling efficiency of the transducer connected to the connector.

4. The apparatus of claim 1, wherein the means for sensing comprises:

first means, coupled to the connector, for detecting a current through the transducer connected to the connector;

second means, coupled to the connector, for detecting a voltage across the transducer connected to the oonneotor; and means, coupled to the first and second means, for computing an impedance in response to the voltage and current, and in response to the impedance and characteristics of the transducer connected to the connector, determining the amount of power radiated.

5. The apparatus of claim 4, wherein the means for sensing includes means for storing characteristics of the transducer connected to the connector.

6. The apparatus of claim 1, further including:

means, programmable by an operator, for selecting the preset radiation power for the transducer connected to the oonneotor.

7. The apparatus of claim 1, Wherein the means for controlling comprises;

means, programmable by an operator, for providing preset dosage of energy;

means for accumulating the power radiated by the transducer over time to determine an amount of radiated energy; and means for turning off the means for supplying when the amount of radiated energy matches the preset dosage of energy.

8. The apparatus of claim 7, wherein the means for providing a preset dosage of energy comprises input means for setting a preset radiation power and a preset treatment time, and means for determining the preset dosage of energy in response to the preset radiation power and the preset treatment time.

9. An apparatus for controlling an ultrasonic transducer, comprising:

a connector adapted to be connected to the transducer connected to the connector for radiating ultrasonic power to a treatment site in response to electric power;

means, coupled to the connector, for supplying a controllable amount of ultrasonic energy to the transducer connected to the oonnector;

means, coupled to the oonnector, for sensing an actual amount of power radiated by the transducer connected to the connector under conditions of varying coupling efficiency during; and means, coupled to the means for sensing and the means for supplying, for controlling the means for supplying in response to the amount of power radiated over time and a preset radiation dosage.

10. The apparatus of claim 9, wherein the means for sensing comprises:

means for detecting a coupling efficiency of the transducer connected to the conneotor.

11. The apparatus of claim 9, wherein the means for sensing comprises:

first means, coupled to the connector, for detecting a current through the transducer connected to the connector;

second means, coupled to the connector, for detecting a voltage across the transducer connected to the connector; and means, coupled to the first and second means, for computing an impedance in response to the voltage and current, and in response to the impedance and characteristics of the transducer connected to the connector, determining the amount of power radiated.

12. The apparatus of claim 11, wherein the means for sensing includes means for storing characteristics of the transducer connected to the connector.

13. The apparatus of claim 9, further including:

means, programmable by an operator, for selecting the preset radiation dosage.

14. The apparatus of claim 9, wherein the means for controlling comprises;

means, programmable by an operator, for providing the preset energy dosage;

means for controlling the amount of power delivered to the transducer in response to a preset radiation power and the amount of power radiated by the transducer;

means for accumulating the power radiated by the transducer over time to determine an amount of radiated energy; and means for turning off the means for supplying when the amount of radiated energy matches the preset dosage of energy.

15. The apparatus of claim 14, wherein the means for providing a preset energy dosage comprises input means for setting a preset radiation power and a preset treatment time, and means for determining the preset energy dosage in response to the preset radiation power and the preset treatment time.

16. The apparatus of claim 15, wherein the means for controlling operates to maintain the amount of power radiated by the transducer essentially constant by controlling electric power delivered by the means for supplying up to a preset maximum amount of electric power.

17. An apparatus for controlling an ultrasonic transducer, comprising:

a connector adapted to be connected to at least one type of ultrasonic transducer;

means, coupled to the connector, for supplying a controllable amount of electric power to a transducer connected to the oonnector;

means for storing characteristics of the at least one type of transducer;

means, coupled to the connector and the means for storing, for determining an amount of power radiated by a transducer connected to the connector in response to stored characteristics of the transducer connected to the connector, and measured impedance of the transducer connected to the connector; and means, coupled to the means for determining and the means for supplying, for controlling the means for supplying in response to the amount of power radiated and a preset radiation power.

18. The apparatus of claim 17, wherein the means for sensing comprises:

means for detecting an actual coupling efficiency of a transducer connected to the connector during conditions of use.

19. The apparatus of claim 17, wherein the means for sensing comprises:

first means, coupled to the oonnector, for detecting a current through the transducer connected to the connector;

second means, coupled to the connector, for detecting a voltage across the transducer connected to the connector; and means, coupled to the first and second means, for computing the measured impedance in response to the voltage and current.

20. The apparatus of claim 17, further including:

means, programmable by an operator and coupled to the means for controlling, for selecting the preset radiation power.

21. The apparatus of claim 17, wherein there are a plurality of types of ultrasonic transducer for which the connector is adapted, and further including:

means, coupled to the connector, for detecting the type of ultrasonic transducer connected to the connector.

22. The apparatus of claim 17, further including:

means, coupled to the connector for automatically determining a resonant frequency of a transducer connected to the connector; and frequency control means, coupled to the means for supplying, for controlling the frequency of the controllable amount of electrical energy in response to the determined resonant frequency.

23. The apparatus of claim 17, wherein the means for controlling comprises;

means, programmable by an operator, for providing preset dosage of energy;

means for accumulating the power radiated by the transducer over time to determine an amount of radiated energy; and means for turning off the means for supplying when the amount of radiated energy matches the preset dosage of energy.

24. The apparatus of claim 23, wherein the means for providing a preset dosage of energy comprises input means for setting a preset radiation power and a preset treatment time, and means for determining the preset dosage of energy in response to the preset radiation power and the preset treatment time.

25. The apparatus of claim 17, wherein the means for controlling operates to maintain the amount of power radiated essentially constant by controlling the amount of electric power up to a preset maximum amount of electric power.

26. An ultrasonic therapy device, comprising: an applicator for applying ultrasonic energy to a treatment site, comprising an ultrasonic transducer and means for indicating an applicator type;

means, programmable by an operator, for storing a preset radiation power for the transducer;

means, responsive to the means for indicating an applicator type, for supplying characteristics of the applicator; and a power control loop including a controllable ultrasound generator, coupled to the applicator, for supplying a controllable amount of electric power to the transducer;

means, coupled to the applicator and the means for supplying characteristics of the applicator, for sensing an actual amount of power radiated by the transducer under conditions of varying coupling efficiency during use; and means, coupled to the means for sensing, to the means for storing the preset radiation power and to the controllable ultrasound generator, for controlling the controllable ultrasound generator in response to the amount of power radiated and the preset radiation power.

27. The apparatus of claim 26, wherein the means for sensing comprises:

first means, coupled to the applicator, for detecting a current through the transducer;

second means, coupled to the applicator, for detecting a voltage across the transducer; and means, coupled to the first and second means and the means for supplying characteristics of the applicator, for computing an impedance in response to the voltage and current, and in response to the impedance and characteristics of the applicator, determining the amount of power radiated.

28. The apparatus of claim 26, wherein the means for sensing comprises:

means for detecting an impedance of the transducer while coupled to the treatment site; and means, coupled to the means for detecting and the means for supplying characteristics of the applicator, for computing the amount of power radiated in response to the impedance and characteristics of the applicator.

29. The apparatus of claim 28, further including:

means, coupled to the means for detecting an impedance, for displaying an indication of coupling efficiency to an operator in response to the impedance.

30. The apparatus of claim 26, further including:

means coupled to the applicator, for automatically determining a resonant frequency of the transducer; and frequency control means, coupled to the means for supplying, for controlling the frequency of the controllable amount of electrical energy in response to the determined resonant frequency.

31. The apparatus of claim 26, further including:

means for indicating a temperature of the applicator; and means, coupled with the power control loop and the means for indicating a temperature of the applicator, for causing the controllable ultrasound generator to supply electoral power to the transducer in order to warm the transducer to a preset operating temperature.

32. An ultrasonic therapy device, comprising:

an applicator for applying ultrasonic energy to a treatment site, comprising an ultrasonic transducer, means for indicating a temperature of the applicator, and means for indicating an applicator type;

means, programmable by an operator, for selecting a first mode with a preset radiation dosage, a second mode with a preset power, and a third mode for transducer detection and calibration, and a fourth mode for applicator warm up;

means, responsive to the means for indicating an applicator type, for supplying characteristics of the applicator; and a power control loop including a controllable ultrasound generator, coupled to the applicator, for supplying a controllable amount of electric power to the transducer;

means, coupled to the applicator and the means for supplying characteristics of the applicator, for sensing in the first mode an amount of power radiated by the transducer, and in the second mode an amount of power delivered to the transducer; and means, coupled to the means for sensing, to the means for selecting and to the controllable ultrasound generator, for controlling the controllable ultrasound generator in the first mode in response to the amount of power radiated and the preset radiation dosage, and in the second mode in response to the amount of power delivered and the preset power; and means, coupled to the applicator, for automatically determining a resonant frequency of the transducer in the third mode; and frequency control means, coupled to the means for supplying, for controlling the frequency of the controllable amount of electrical energy in response to the determined resonant frequency during the first and second modes; and means, coupled with the power control loop and the means for indicating a temperature of the applicator, for causing the controllable ultrasound generator to supply electrical power to the transducer in order to warm the transducer to a preset operating temperature in the fourth mode.

33. The apparatus of claim 32, wherein the means for sensing comprises:

first means, coupled to the applicator, for detecting a current through the transducer;

second means, coupled to the applicator, for detecting a voltage across the transducer; and means, coupled to the first and second means and the means for supplying characteristics of the applicator, for oomputing an impedance in response to the voltage and current, and in response to the impedance and characteristics of the applicator, determining the amount of power radiated in the first mode and the amount of power delivered in the second mode.

34. The apparatus of claim 32, wherein the means for sensing comprises:

means for detecting a coupling efficiency of the transducer to the treatment site; and means, coupled to the means for detecting and the means for supplying characteristics of the applicator, for computing in the first mode the amount of power radiated in response to the coupling efficiency and characteristics of the applicator.

35. The apparatus of claim 32, wherein the means for controlling the controllable ultrasound generator comprises;

means for controlling the amount of power delivered to the transducer in response to a preset radiation power and the amount of power radiated by the transducer;

means for accumulating the power radiated by the transducer over time to determine an amount of radiated energy; and means for turning off the means for supplying when the amount of radiated energy matches the preset dosage of energy.

36. The apparatus of claim 32, wherein the means for selecting comprises input means for setting a preset radiation power and a preset treatment time, and means for determining the preset radiation dosage in the first mode in response to the preset radiation power and the preset treatment time.

37. The apparatus of claim 32, wherein the means for controlling operates to maintain the amount of power radiated essentially constant by controlling the amount of electric power up to a preset maximum amount of electric power.

* * * * *